US006719251B1

(12) United States Patent
Eastland et al.

(10) Patent No.: US 6,719,251 B1
(45) Date of Patent: Apr. 13, 2004

(54) CHRISTMAS TREE BOW TOPPER

(76) Inventors: Carolyn E. Eastland, 577 Hazelwood Dr., Florence, AL (US) 35633; Dedra E. Pennington, 615 Parkside Cir., Helena, AL (US) 35080

( * ) Notice: Subject to any disclaimer, the term of this patent is extended or adjusted under 35 U.S.C. 154(b) by 0 days.

(21) Appl. No.: 10/254,582

(22) Filed: Sep. 26, 2002

(51) Int. Cl.[7] ..... F16M 13/02
(52) U.S. Cl. ..... 248/175; 248/27.8; 428/19
(58) Field of Search ..... D11/121; 248/27.8, 248/175; 428/19; 24/713.6, 572.1; D8/356

(56) References Cited

U.S. PATENT DOCUMENTS 2,714,776 A 8/1955 Lee
3,210,232 A * 10/1965 Wielland ..... 428/7
3,676,275 A 7/1972 Sloane
4,736,282 A 4/1988 Ahroni
5,301,463 A * 4/1994 Domurat ..... 47/41.01
5,422,801 A 6/1995 Sangalli
5,523,130 A 6/1996 Sullivan
6,237,882 B1 * 5/2001 DiMuzio ..... 248/175
6,385,901 B1 * 5/2002 Wahlberg ..... 47/45

* cited by examiner

*Primary Examiner*—Deborah Jones
*Assistant Examiner*—Arden Sperty
(74) *Attorney, Agent, or Firm*—Patent & Trademark Services, Inc.; Joseph H. McGlynn

(57) ABSTRACT

A frame system attached to the top of a Christmas tree which allows decorations, such as bows, to be secured to the frame and which will decorate the tree.

12 Claims, 1 Drawing Sheet

CHRISTMAS TREE BOW TOPPER

BACKGROUND OF THE INVENTION

This invention relates, in general, to Christmas tree decorations, and, in particular, to a frame system for Christmas tree decorations that allow decorations to be secured to the top of a Christmas tree.

DESCRIPTION OF THE PRIOR ART

In the prior art various types of devices have been proposed. For example, U.S. Pat. No. 2,714,776 to Lee discloses a tinsel package which is attached to a tree by means of a grommet with an aperture through the grommet.

U.S. Pat. No. 3,676,275 to Sloane discloses a decorative tree covering having a plurality of strands which drape the tree from the top and decorations are attached to the strands.

U.S. Pat. No. 4,736,282 to Ahroni discloses a light assembly for a tree having a collar attached to the top of the tree from which lights are suspended.

U.S. Pat. No. 5,422,801 to Sangalli, Jr. discloses a plurality of rings attached to a tree to which lights are attached.

U.S. Pat. No. 5,523,130 to Sullivan discloses a decorating system with a hanger at the top of the tree and decorations are suspended from the hanger.

SUMMARY OF THE INVENTION

The present invention is directed to a frame attached to the top of a Christmas tree which allows decorations, such as bows, to be secured to the frame and which will decorate the tree.

It is an object of the present invention to provide a new and improved Christmas tree decoration.

It is an object of the present invention to provide a new and improved Christmas tree decoration that is easy to apply to a tree.

It is an object of the present invention to provide a new and improved Christmas tree decoration that can be used to apply a variety of decorations to a tree.

These and other objects and advantages of the present invention will be fully apparent from the following description, when taken in connection with the annexed drawings.

DESCRIPTION OF THE PREFERRED EMBODIMENT

Figure 1:
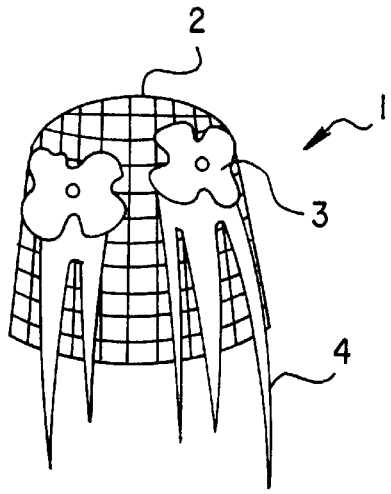
FIG. 1 is front view of the wire frame of the present invention which will be placed on top of a Christmas tree.
Figure 2:
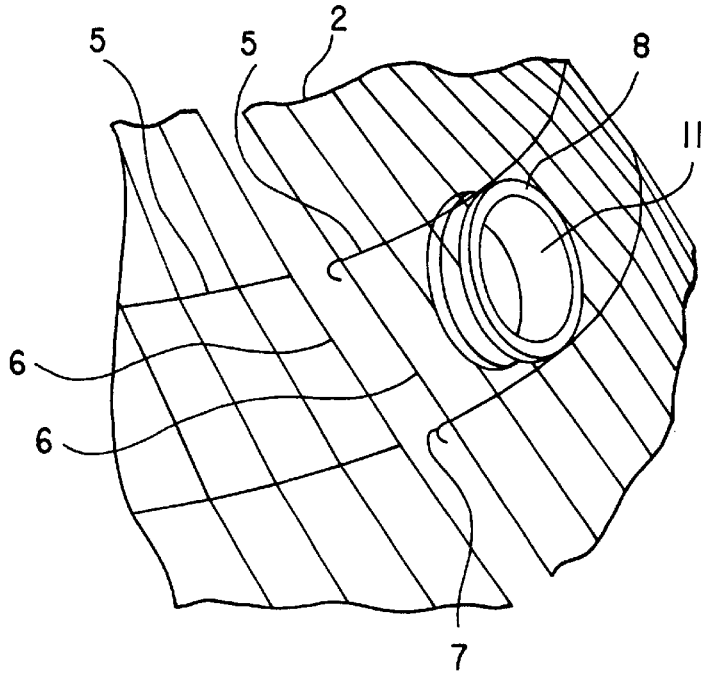
FIG. 2 is a partial view of the wire frame of the present invention.

Referring now to the drawings in greater detail, FIG. 1 shows the present invention 1 which will be placed over the top of a Christmas tree, not shown. The present invention comprises a wire frame 2 made up of a plurality of horizontal wires 5 and a plurality of vertical wires 6 which are secured together (as shown in FIG. 2) in any conventional manner. The distance between wires 5, 6 is preferably one inch, however, other distances can be chosen without departing from the scope of the invention. The wire frame 2 of the present invention is preferably dome shaped, although other shapes could be used without departing from the scope of the invention.

The wire frame has a separation between adjacent ends, which will usually be placed at the back of the tree so it can not be seen when the frame is placed on the tree. This allows the frame to be adjusted to different size trees. On one end of the separation, a plurality of hooks 7 are formed on the ends of horizontal wires 5 (see FIG. 2). The hooks can be secured to selected vertical wires 6 to change the size of the wire frame 2.

Figure 3:
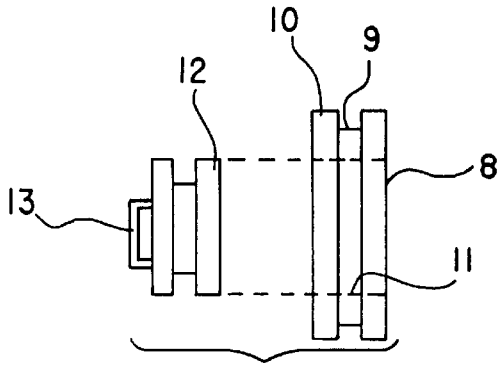
FIG. 3 is a side view of one of the grommets and the insertion plug of the present invention.

As shown in FIG. 2, a plurality of grommets 8 are inserted into the apertures formed between the vertical and horizontal wires 6, 5. The grommets are preferably made from a slightly resilient material, such as, but not limited to, rubber or plastic. As shown in FIG. 3, each grommet has ends 8, 10 with a groove 9 between the ends. The diameter of the ends 8, 10 are larger that the apertures between the horizontal and vertical wires 5, 6, and the diameter of the groove 9 is approximately the same size as the apertures between the horizontal and vertical wires 5, 6. This will allow the grommets to be squeezed into the apertures between the horizontal and vertical wires 5, 6 and be securely retained therein.

In order to squeeze the grommets into the apertures between the horizontal and vertical wires 5, 6, a plug 12 is used. The diameter of the plug 12 is approximately the same size as the aperture 11 in the grommet. The plug has a handle 13 integrally secured thereto, so the plug can be inserted into the grommet, and then the handle can be used to squeeze the grommet into the apertures between the horizontal and vertical wires 5, 6.

Once the grommets are secured to the wire frame, bows 3, 4, or other decorations, can be secured to the grommets by any conventional means, such as, but not limited to, wires. By securing the bows to the grommets instead of directly to the wire frame,the position of the bows can be easily changed if the user is not satisfied by the positioning of the bows.

Although the Christmas Tree Bow Topper and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

We claim:

1. A frame system for decorating a Christmas tree, wherein said frame system comprises:

a frame composed of a plurality of vertical and horizontal members, apertures formed between said plurality of vertical and horizontal members, said apertures having a selected size, and at least one grommet, said grommet having a first outside dimension and a second outside dimension, said first outside dimension being larger than said selected size of said apertures, and said second outside dimension being approximately the same size as said selected size of said apertures.

2. The frame system as claimed in claim 1, wherein said frame has means for changing a size of said frame.

3. The frame system as claimed in claim 2, wherein said means for changing a size of said frame comprises a separation between adjacent portions of said frame, and a plurality of hooks formed on one of said adjacent portions, said plurality of hooks being secured to selected ones of said vertical members on another adjacent portion of said frame.

4. The frame system as claimed in claim 1, wherein there are a plurality of grommets, and each of said grommets has an aperture extending therethrough.

5. The frame system as claimed in claim 4, wherein said apertures extending through said grommets have a selected size.

6. The frame system as claimed in claim 4, wherein said frame system has means for inserting said grommets into said apertures between said vertical and horizontal members.

7. The frame system as claimed in claim 6, wherein said means for inserting said grommets into said apertures between said vertical and horizontal members comprises a plug, said plug having an outside dimension which is approximately the same size as the selected size of said apertures in said grommets.

8. The frame system as claimed in claim 7, wherein said plug has means for inserting said plug into said apertures in said grommets, and for inserting said grommets into said apertures between said vertical and horizontal members.

9. The frame system as claimed in claim 8, wherein said means for inserting said plug into said apertures in said grommets, and for inserting said grommets into said apertures between said vertical and horizontal members comprises a handle on said plug.

10. The frame system as claimed in claim 9, wherein said handle is U-shaped.

11. The frame system as claimed in claim 1, wherein decorations are secured to said at least one grommet.

12. The frame system as claimed in claim 11, wherein said decorations are at least one bow.

* * * * *